US007811220B2

(12) United States Patent
Wolff et al.

(10) Patent No.: US 7,811,220 B2
(45) Date of Patent: Oct. 12, 2010

(54) DEVICE FOR PROCESSING FILTER TOW MATERIAL, AND DEVICE FOR THE PRODUCTION OF FILTERS

(75) Inventors: Stephan Wolff, Glinde (DE); Sönke Horn, Geesthacht (DE); Joachim Glogasa, Geesthacht (DE); Volker Fricke, Buchholz (DE); Ralf Meyer, Bohlsen (DE); Manfred Dallmann, Lüneburg (DE); Viktor Kondratschew, Lübeck (DE)

(73) Assignee: Hauni Maschinenbau AG, Hamburg (DE)

( * ) Notice: Subject to any disclaimer, the term of this patent is extended or adjusted under 35 U.S.C. 154(b) by 727 days.

(21) Appl. No.: 10/580,412

(22) PCT Filed: Nov. 16, 2004

(86) PCT No.: PCT/EP2004/012946

§ 371 (c)(1),
(2), (4) Date: Feb. 22, 2007

(87) PCT Pub. No.: WO2005/058079

PCT Pub. Date: Jun. 30, 2005

(65) Prior Publication Data

US 2007/0157938 A1 Jul. 12, 2007

(30) Foreign Application Priority Data

Nov. 25, 2003 (DE) ..... 103 54 924

(51) Int. Cl.
*B31C 99/00* (2009.01)

(52) U.S. Cl. ..... 493/49; 493/42

(58) Field of Classification Search ..... 493/39–50
See application file for complete search history.

(56) References Cited

U.S. PATENT DOCUMENTS

| | | | | |
|---|---|---|---|---|
| 2,629,296 | A * | 2/1953 | Feyrer | 493/390 |
| 2,666,515 | A * | 1/1954 | Pateman et al. | 400/82 |
| 2,898,998 | A * | 8/1959 | Schur | 493/46 |
| 4,208,956 | A * | 6/1980 | Hall | 493/46 |
| 4,281,671 | A * | 8/1981 | Bynre et al. | 493/49 |
| 4,425,106 | A * | 1/1984 | Boegli et al. | 493/45 |

(Continued)

FOREIGN PATENT DOCUMENTS

DE 1 532 142 5/1971

(Continued)

OTHER PUBLICATIONS

State Intellectual Property Office, P.R. China Second Office Action, dated Apr. 13, 2010, issued in connection with counterpart Chinese Application No. 200480034822.6.

*Primary Examiner*—Louis K Huynh
(74) *Attorney, Agent, or Firm*—Venable LLP; Robert Kinberg; Ryan M. Flandro

(57) ABSTRACT

A device for processing filter tow material used for producing filters for rod-shaped smoking articles such as cigarettes. The device includes a filter tow supply to provide at least two filter tow strips to at least two filter tow guideways. Each of the at least two filter tow strips is directed within the at least two filter two guideways, respectively. Apparatuses are also provided for processing the filter tow strips. The device includes a separately controllable independent processing apparatus assigned to each filter tow guideway.

20 Claims, 8 Drawing Sheets

U.S. PATENT DOCUMENTS

| | | | | | |
|---|---|---|---|---|---|
| 4,468,845 | A * | 9/1984 | Harris | 493/44 |
| 4,549,875 | A * | 10/1985 | Pryor | 493/49 |
| 4,883,075 | A * | 11/1989 | Mattei et al. | 131/84.1 |
| 4,945,926 | A * | 8/1990 | Mattei et al. | 131/84.1 |
| 5,116,298 | A * | 5/1992 | Bondanelli et al. | 493/40 |
| 5,235,794 | A * | 8/1993 | Center | 53/437 |
| 5,460,590 | A * | 10/1995 | Greiner et al. | 493/50 |
| 5,515,772 | A * | 5/1996 | De Groen | 99/289 T |
| 5,725,467 | A * | 3/1998 | Chehab et al. | 493/42 |
| 6,006,501 | A * | 12/1999 | Davis et al. | 53/451 |
| 6,047,526 | A * | 4/2000 | Draghetti | 53/443 |
| 6,059,706 | A * | 5/2000 | Chehab et al. | 493/50 |
| 6,874,299 | B2 * | 4/2005 | Basque | 53/449 |
| 6,908,421 | B2 * | 6/2005 | Koborinai et al. | 493/39 |
| 7,076,935 | B2 * | 7/2006 | Basque | 53/551 |
| 7,140,164 | B2 * | 11/2006 | Fietkau | 493/39 |
| 7,261,681 | B2 * | 8/2007 | Pehmoller et al. | 493/49 |
| 2005/0193689 | A1 * | 9/2005 | Basque | 53/451 |
| 2005/0288163 | A1 * | 12/2005 | Caenen et al. | 493/39 |

FOREIGN PATENT DOCUMENTS

| | | | |
|---|---|---|---|
| DE | 28 52 948 | A1 | 6/1979 |
| DE | 42 09 606 | A1 | 9/1993 |
| DE | 42 09 789 | A1 | 9/1993 |
| DE | 43 08 093 | A1 | 9/1993 |
| DE | 100 10 176 | A1 | 9/2001 |
| DE | 101 55 292 | A1 | 5/2003 |
| EP | 0 682 881 | A2 | 11/1995 |
| EP | 0 715 816 | A2 | 6/1996 |
| GB | 2 265 298 | A | 9/1993 |
| WO | WO 03/039276 | A1 | 5/2003 |

* cited by examiner

DEVICE FOR PROCESSING FILTER TOW MATERIAL, AND DEVICE FOR THE PRODUCTION OF FILTERS

This Application is a National Stage Application of International Application No. PCT/EP2004/012946, which claims the priority of German Patent Application No. 103 54 924.2, filed Nov. 25, 2003.

BACKGROUND OF THE INVENTION

1. Field of the Invention

The invention relates to a device for processing filter tow material for the production of filters for rod-shaped smoking articles such as cigarettes. The device comprises filter tow delivery means for supplying at least two filter tow strips, at least two tow guideways for transporting respectively one filter tow strip in each tow guideway, and apparatuses for processing the filter tow strips. The invention furthermore relates to a machine for producing filters for rod-shaped smoking articles such as cigarettes with the aid of said machine, as well as to an apparatus for wrapping the filter tow material with a wrapping material and an adhesive applicator for gluing together the wrapping material.

2. Related Art

A device of this type is known, for example, from reference DE 42 09 789 A1 or reference DE 43 08 093 A1. These known devices are used for producing filter rods with the dual-rod method. In the process, filter tow strips (e.g. of cellulose acetate fibers) are pulled from a bale, are processed by drawing and treating them with a plasticizer, and are transferred for further processing to a continuous filter-rod unit once the desired shape and consistency is reached. This unit produces a continuous filter rod by wrapping the processed filter-tow strip with a wrapping material ribbon, wherein the continuous filter rod is then cut into individual filter-rod sections for cigarettes or other rod-shaped smoking articles.

SUMMARY OF THE INVENTION

It is the object of the present invention to further improve a device of the aforementioned type.

This object is solved with a device for processing filter tow material for producing filters for rod-shaped smoking articles such as cigarettes, said device comprising filter tow delivery means for supplying at least two filter tow strips, at least two tow guideways for transporting respectively one filter tow strip in each tow guideway, as well as apparatuses for processing the filter tow strips, characterized in that a separate processing apparatus, which can be controlled separately, is assigned to each tow guideway.

With the aid of the invention, it is not only possible to produce and process at least two filter tow strips simultaneously, but the processing apparatuses can also be controlled separately with respect to each tow guideway. The measure proposed according to the invention not only results in a considerable increase in the filter production capacity, with relatively low structural and machine expenditure and a lower space and area requirement as compared to the use of a corresponding number of single-rod machines, but the measure furthermore permits on the one hand a partial-load operation and, on the other hand, the production and processing of different types of filters with one and the same device. According to the invention, the latter is achieved with the aid of a separate control for each processing apparatus assigned to each tow guideway, meaning separately from the processing apparatus assigned to the other tow guideways. The characteristics of the products to be produced in the different tow guideways can thus be influenced individually. As a result, it is not only possible to produce and process products with identical characteristics, as is the case exclusively according to the teaching in the DE 43 08 093 A1, but also products with different characteristics, which are more and more in demand in the marketplace.

For the production of different types of filters, it may be useful if the filter tow delivery means supply a different filter tow material to each tow guideway. The filter tow delivery means normally comprise two or more bales from which respectively one filter tow strip is pulled. However, they can also comprise only a single bale and a down-stream arranged cutting device for cutting the material strip pulled from the single bale in longitudinal direction into two or more separate filter tow strips.

Each processing device is normally provided with means for flattening, drawing and/or treating the filter tow material. According to the invention, separately controlled means for flattening, drawing and/or treating the filter tow material are provided, relative to each tow guideway, for achieving the previously described effects. A separately controlled means for drawing should therefore be provided for each tow guideway to allow the separate drawing of the respective filter tow strip in the associated tow guideway. The means for drawing the filter tow material are particularly well suited for individually influencing the filter tow strips in each tow guideway because they directly influence the characteristic features of the produced products, such as the density or the pull resistance.

It is preferable if means for flattening, drawing and/or treating the filter tow material are assigned to each tow guideway. The means for flattening, the means for drawing and/or the means for treating respectively form a single unit, in which they are arranged side-by-side in the direction transverse to the movement direction of the tow guideways. With this type of design, the number of means provided for the flattening, for the drawing and/or for the treatment correspond to the number of tow guideways, wherein respectively all means for flattening form a unit, all means for drawing form a unit and/or all means for the treatment form a unit.

According to a modification of the aforementioned embodiment, each means for flattening and/or drawing is provided with a pair of rollers positioned on the same side and driven by associated drive means. The positioning of the rollers on the same side has the advantage of allowing easier access, in particular when setting up the device or correcting a faulty operation.

According to a different modification of the previously-mentioned embodiment, the roller pairs for the flattening and/or drawing means, which respective form a unit, are positioned coaxially side-by-side, thereby resulting in an especially space-saving arrangement. In that case, the first roller of the outer roller pair can be positioned on a first shaft and the first roller of the inner roller pair can be positioned on a first tubular shaft through which the first shaft extends. The same separate positioning with the aid of a shaft-tubular shaft arrangement can also be realized for the second rollers of the roller pairs. With this type of embodiment, at least the rollers of the inner roller pair are accordingly embodied as cylinders.

A different preferred embodiment is distinguished in that a spray-box arrangement is used as means for treating the filter tow material. This spray-box arrangement extends at an angle, preferably transverse, across the tow guideways and is provided on the wall facing the tow guideways with discharge openings assigned to the tow guideways for spraying the treatment fluid onto the filter tow material. A first separating wall is respectively arranged within the spray-box arrangement, at the location between the tow guideways, and a second separating wall is respectively arranged on the wall facing the tow guideways, so as to prevent the treatment material sprayed onto the filter tow material on the different tow guideways from coming in contact, in particular to avoid accidental wetting caused by turbulence.

According to a further modification of the aforementioned embodiment, the cross section for the discharge openings can be changed separately, relative to each tow guideway, preferably by using movable apportioning plates, so that the filter tow material in each tow guideway can be treated individually. In the process, either a single discharge opening can be provided for each tow guideway, generally in the form of a slot, or a plurality of discharge openings can be provided, which are usually round in shape.

It is useful if the spray-box arrangement operates under pressure. Alternatively or additionally, it is also conceivable for the spray-box arrangement to contain at least one rotating brush, operated by a drive, which dispenses the treatment fluid through the discharge openings.

Two conical intake fingers, bent twice, can furthermore be provided downstream of an apparatus for shaping two filter tow strips into two round continuous filter tow rods. Respectively one continuous filter tow rod is guided through each intake finger to reduce the spacing between the filter tow rods and achieve a parallel alignment of the filter tow rods.

According to a different modification of the aforementioned embodiment, the intake fingers can jointly be attached to a single holder, which is suspended from a parallelogram frame that can be pivoted substantially in the direction of the filter tow rods. Both intake fingers can thus be pivoted toward the back, preferably parallel to a machine wall, in particular for setting up the machine or for maintenance and repair purposes.

Deflection means can furthermore be provided in downstream direction, following the shaping apparatus, wherein these preferably comprise at least one deflection roller for deflecting the round filter tow rods in any optional direction. In a similar manner as the previously-mentioned intake fingers, deflection means of this type can function to reduce the spacing between the filter tow rods. Alternatively or additionally, the deflection means can be arranged at an angle, between the device for processing filter tow material and an adjoining continuous filter-rod unit. Finally, it is possible to arrange tow bales optionally at different locations by allowing an intertwining of the tow in the drawing zone.

A separate removal device can furthermore be provided at the end of each tow guideway, which preferably comprises a pusher drum or a transfer spider for changing the position of the cut filter tow rods from a longitudinal axial positioning to a transverse axial positioning, relative to the movement direction. The arrangement of separate removal devices of this type makes it possible to operate different and in particular physically separate filter rod units or cigarette production machines. To be sure, reference EP 0 682 881 B1 already teaches the embodiment and arrangement in pairs of pusher drums. However, these traditional pusher drums are used for transporting cut cigarette rods and are connected to additional transfer drums, such that the cigarette rods discharged from both pusher drums are again combined to form a single flow.

Finally, the invention also relates to a machine for producing filters for rod-shaped smoking articles, comprising a device of the aforementioned type, as well as an apparatus for wrapping the filter tow strips with the wrapping material and an adhesive applicator for gluing the wrapping material. The adhesive applicator in this case can be provided with first means for applying slow-curing adhesive, in particular cold glue, and second means for applying fast-curing adhesive, in particular hot-melt glue. An adhesive applicator embodied in this way represents a separate aspect of the invention and can also be realized with single-rod systems. An adhesive applicator of this type in particular has the advantage that the slow-curing adhesive and the fast-curing adhesive can be applied simultaneously, wherein the fast-curing adhesive initially causes an immediate fixation of the wrapping material while the slow-curing adhesive results in a permanent bonding. A fast-curing adhesive, for example hot-melt glue, has the disadvantageous characteristic of losing its adhesive effect after a longer period of time. A dual application of slow-curing and fast-curing adhesives therefore recommends itself, especially for high processing speeds. With low processing speeds on the other hand, in particular for the partial-load operation, it is sufficient to activate only the first means for applying the slow-curing adhesive.

BRIEF DESCRIPTION OF THE SEVERAL VIEWS OF THE DRAWINGS

Preferred embodiments of the invention are explained in further detail in the following, with the aid of the enclosed drawings and showing in.

DETAILED DESCRIPTION OF THE INVENTION

Figure 1:
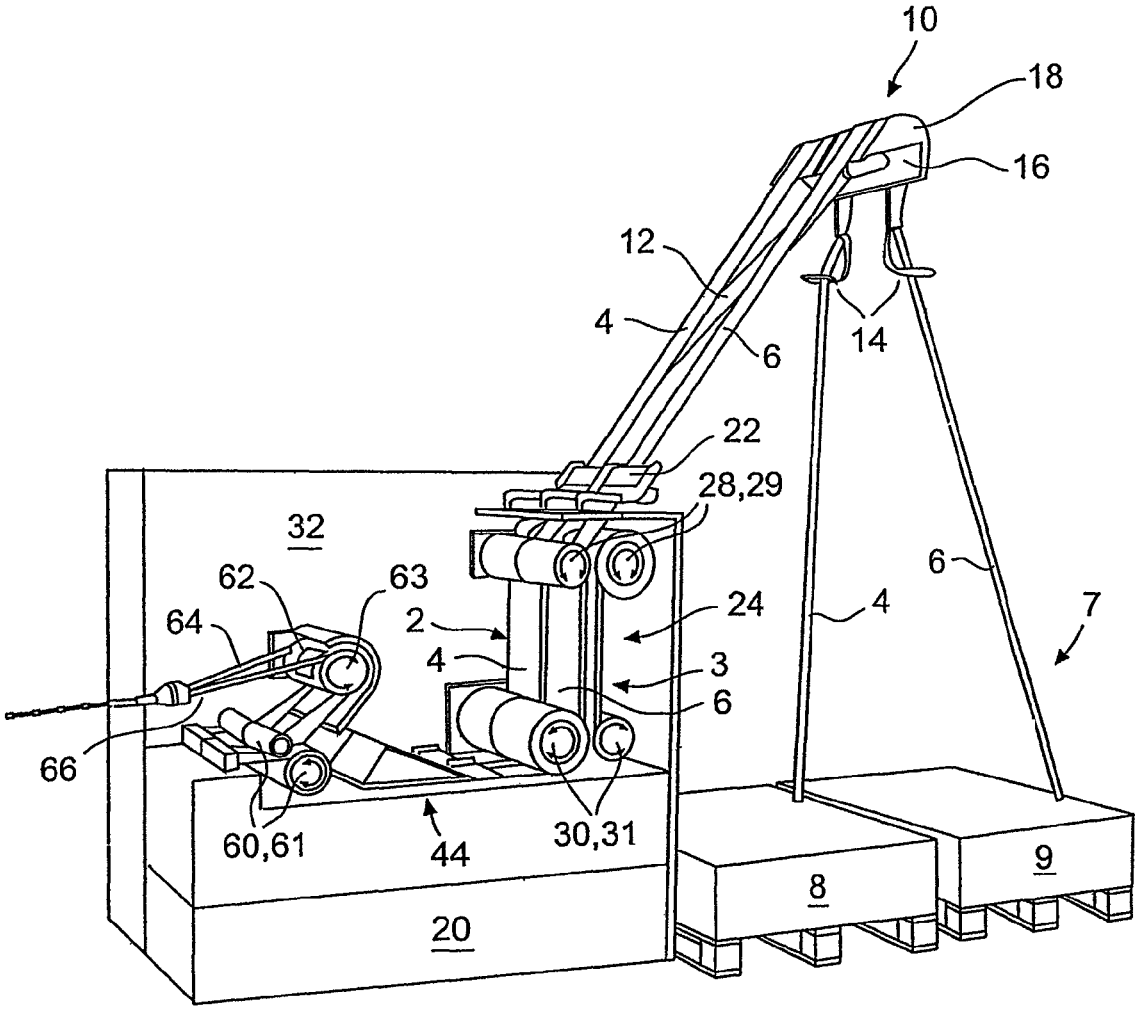
FIG. 1 A schematic, perspective view from the side of a dual-rod machine according to the invention.

The Figures in part show the complete machine and in part only details of a machine according to the invention for processing filter tow material for the production of filters for rod-shaped smoking articles, in particular cigarettes produced with the continuous-rod method, wherein the individual Figures for the most part show only the components necessary for understanding the invention. To provide a better overview, most standard machine components are not shown in the Figures, for example details of the machine frame, holders, bearings, and cladding.

The illustrated filter tow processing machine is provided with two tow guideways 2 and 3, which guide two side-by-side arranged filter tow strips 4 and 6 through the machine. For the exemplary embodiment, the filter tow strips 4 and 6 are pulled from a filter tow supply 7, which contains two side-by-side arranged filter tow bales 8 and 9. Alternatively, the filter tow strips 4 and 6 can conceivably also be stored in a single bale, or a wider material strip can be pulled from a single bale and can subsequently be cut with a cutting device in longitudinal direction into two separate filter tow strips.

The machine for the exemplary embodiment shown herein is provided above the filter tow store 7 with a deflection and tow flattening element 10, arranged at the upper end of a support arm 12, as well as two side-by-side arranged tow guideways 14. First spreader nozzles 16 are furthermore provided on the deflection and tow flattening element 10, which respectively act upon the two filter tow strips 4 and 6, so as to flatten each into a flat strip.

Second spreader nozzles 22 are arranged on a schematically shown machine frame 20, wherein the filter tow strips 4 and 6 arriving from the deflection and tow flattening element 10 are guided past these spreader nozzles.

A dual-path drawing device 24 follows the second spreader nozzles 22. As shown in particular with FIGS. 2 and 3, this drawing device 24 comprises first and second braking roller pairs 26, 27 and first and second drawing roller pairs 28 and 29, which are arranged downstream behind the braking roller pairs 26, 27, as well as third and fourth drawing roller pairs 30 and 31, which are arranged downstream of the first and second drawing roller pairs 28, 29. The first braking roller pair 26, the first drawing roller pair 28, and the third drawing roller pair 30 are assigned to the first tow guideway 2 and the second braking roller pair 27, the second drawing roller pair 29, and the fourth drawing roller pair 31 are assigned to the second tow guideway 3.

The first and second braking roller pairs 26 and 27, the first and second drawing roller pairs 28 and 29, as well as the third and fourth drawing roller pairs 30 and 31 are respectively positioned side-by-side and coaxial to each other. It should also be pointed out in this connection that the drawing roller pairs 28, 29 and 30, 31 are both positioned on the same side, meaning on a vertical back wall 32 of the machine frame 20. As a result, they can be accessed easily, in particular for setting up a machine or for correcting a faulty operation, as shown especially in FIGS. 1 and 3.

Figure 4:
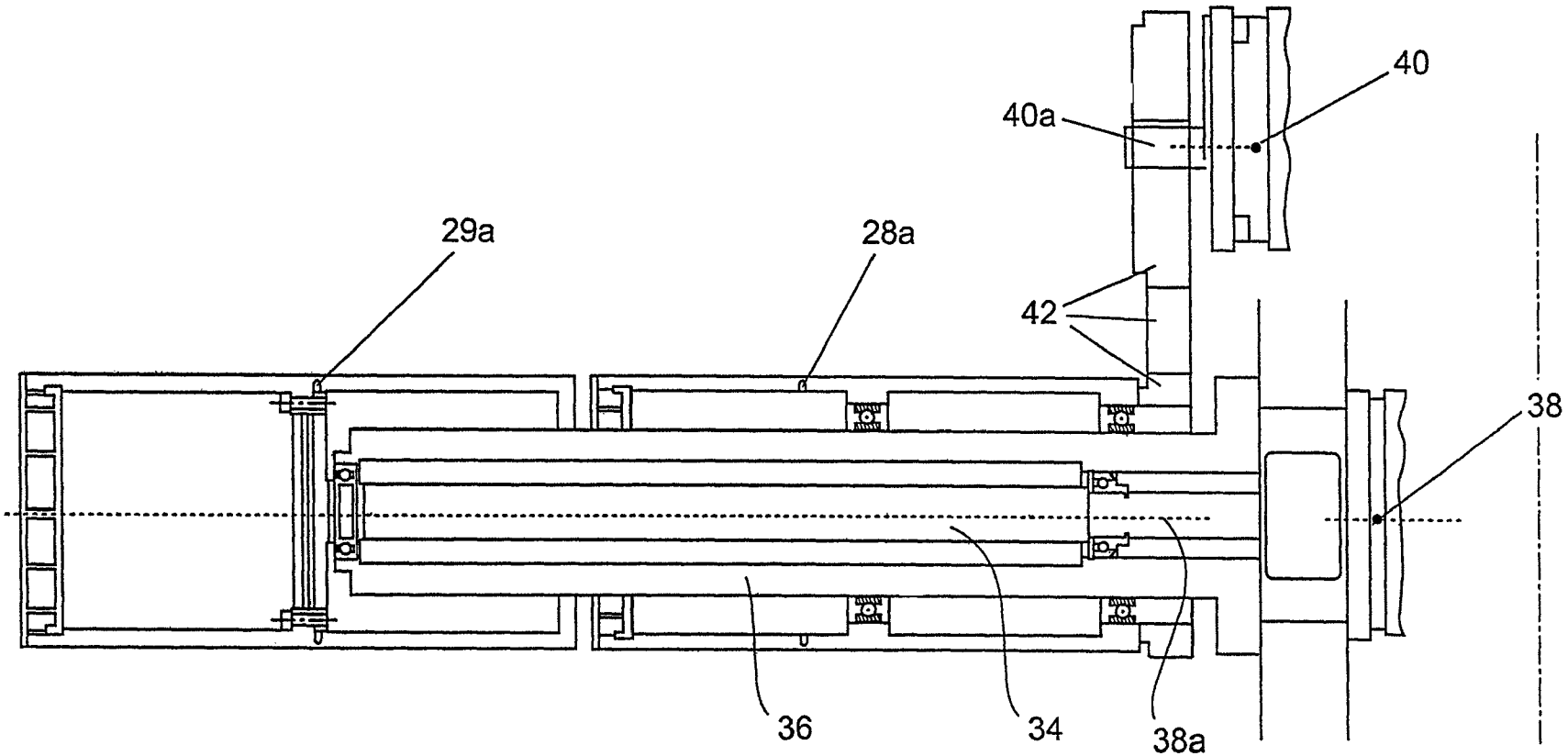
FIG. 4 The coaxial positioning of two rollers, shown in a sectional view.

The positioning on the same side of the drawing rollers in particular is realized for the embodiment shown herein with the aid of a shaft-tubular shaft arrangement, shown in FIG. 4 with a schematic cross-section through the first rollers 28*a*, 29*a* of the first and second drawing roller pairs 28, 29. Based on this, the outer roller 29*a* is fixedly connected to a shaft 34 and is arranged coaxial to this shaft. This shaft 34 is guided through a tubular shaft 36, is arranged coaxial thereto, and is positioned rotating thereon. The tubular shaft 36 is flanged immovably to the machine frame. A first drive 38 for rotating the shaft 34 and thus also the outer roller 29*a* is furthermore arranged on the machine frame. For the exemplary embodiment shown herein, the output shaft 38*a* for the first drive 38 is fixedly connected to the shaft 34 and is arranged coaxial thereto. The inside-positioned roller 28*a* surrounds the tubular shaft 36 and is arranged coaxial to thereto and rotating thereon. In the same way as the outer roller 29*a*, the inner roller 28*a* is driven by a separate drive. For the embodiment shown in FIG. 4, this is a second drive 40, for which the output shaft 40*a* is connected via a toothed gear 42 to the inner roller 28*a*. The same arrangement is also provided for the third and fourth roller pairs 30 and 31.

Accordingly, a separate drive is assigned to each of the first, second, third and fourth drawing roller pairs 28, 29, 30 and 31, which can be separately controlled by a control device that is not shown herein. The characteristics of the two filter tow strips 4 and 6 in the two tow guideways 2 and 3 can thus be controlled and also adjusted separately, thereby making it possible to produce filter rods with different characteristics in the two tow guideways 2 and 3.

Figure 2:
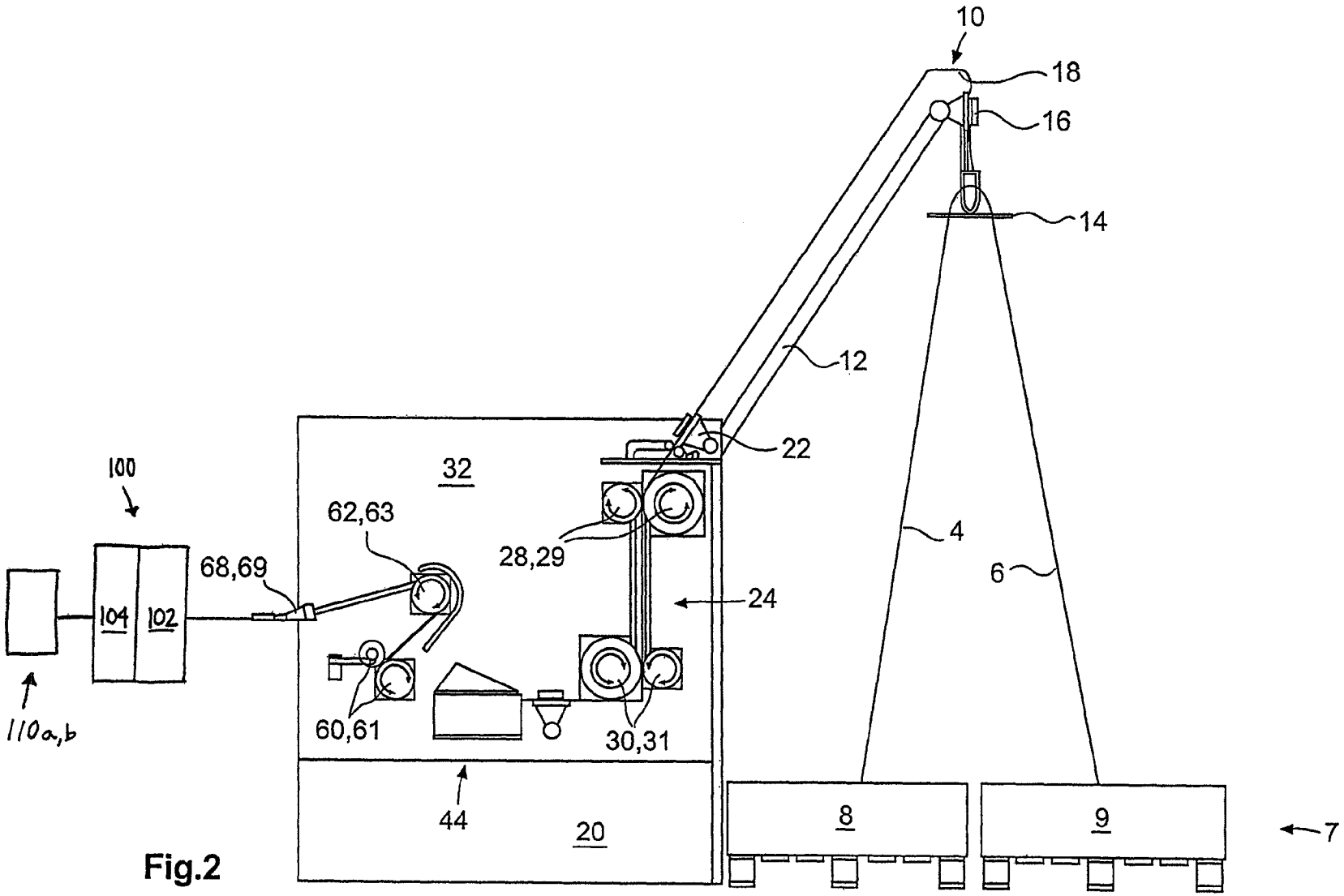
FIG. 2 A schematic view from the side of the machine shown in FIG. 1.
Figure 3:
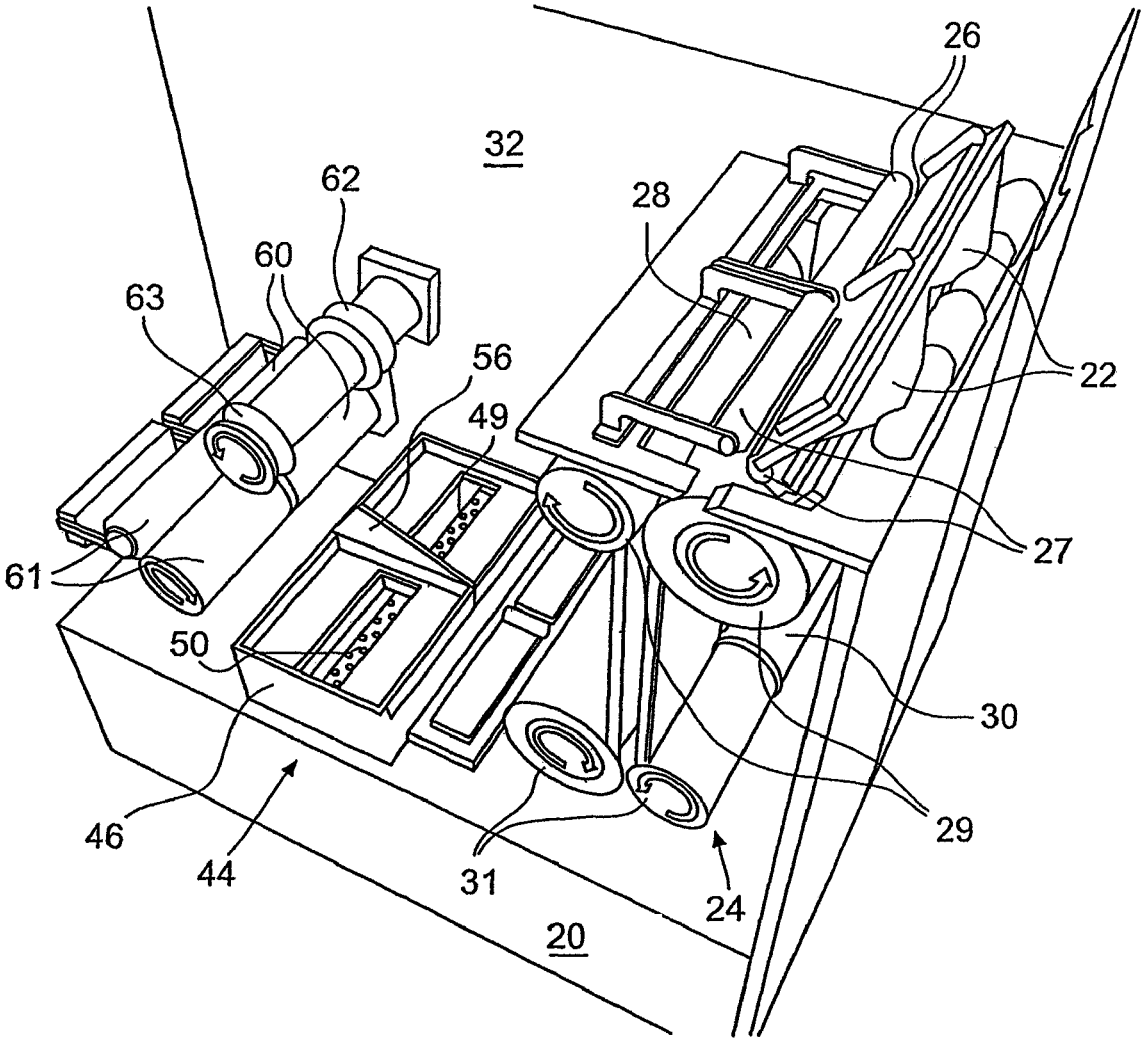
FIG. 3 A perspective view of a section of the machine shown in FIG. 1.

FIGS. 1 to 3 show that each of the first, second, third, and fourth drawing roller pairs 28, 29, 30, and 31 contains a slender roller with a smaller diameter and a larger roller with a larger diameter. In general, the slender roller of each drawing roller pair is made of steel and is driven separately by the associated drive. In contrast, the larger rollers generally are embodied as rubber rollers or are provided with a rubber layer on the outside. In generally the larger rollers are not provided with a drive, but can be adjusted separately in transverse direction, relative to their axis of rotation, with the aid of control elements that are not shown herein. The separate mounting of the individual larger rollers furthermore allows a separate control of the contact pressure.

The third and fourth drawing roller pairs 30 and 31 are driven with a higher circumferential speed by the separate drives assigned to these rollers than the first and second drawing roller pairs 28 and 29. A defined drawing of the associated filter tow strip 4 and/or 6 therefore occurs between the first and third drawing roller pairs 28 and 30, as well as between the second and fourth drawing roller pairs 29 and 31. As previously mentioned and shown in FIG. 1, the first and third drawing roller pairs 28 and 30 grip the first filter tow strip 4 and the second and third drawing roller pair 29 and 31 grip the second filter tow strip 6, thereby allowing an independent drawing of the two filter tow strips 4 and 6, as previously mentioned.

The same is true for the braking roller pairs 26 and 27, as mentioned before. The first braking roller pair 26 is assigned to the first filter tow strip 4 and the second braking roller pair 27 is assigned to the second filter tow strip 6. The braking roller pairs 26 and 27 are therefore operated separately by means of separately assigned operating elements, which can be used to influence the braking force applied by the braking roller pairs 26, 27 onto the filter tow strips 4, 6. The operating elements can be electric braking devices which are not shown in the Figures and which transfer a braking moment onto the braking rollers 26, 27. It is also possible to provide electric, hydraulic or pneumatic adjustment elements for adjusting at least one roller of the two roller pairs 26, 27, in the direction transverse to their rotational axis, and thus control the contact pressure of the braking rollers.

Figure 5:
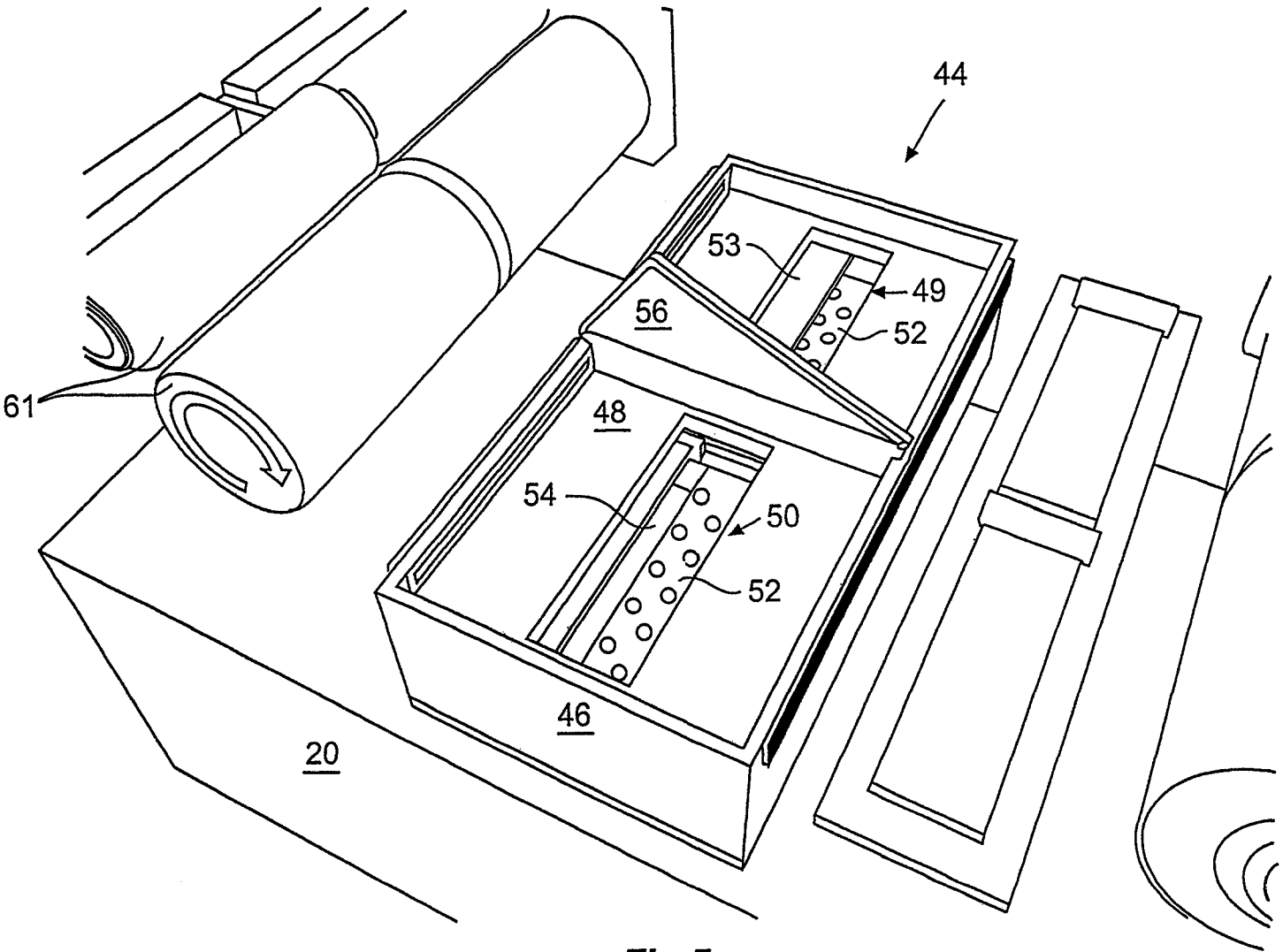
FIG. 5 An enlarged perspective representation of a section of the machine shown in FIG. 1.

Arranged downstream of the third and fourth drawing roller pairs 30, 31 is a means for treating the filter tow material with additives, meaning the apparatus 44 for applying a liquid plasticizer onto the flattened filter tow strips 4, 6. FIGS. 3 and 5 in particular show that the apparatus 44 comprises a spray box 46 that extends in transverse direction across the tow guideways 2 and 3. The top 48 of the spray box 46, which faces the filter tow strips 4 and 6, is provided with two adjacent, slot-shaped openings 49 and 50, wherein the first opening 49 is assigned to the first tow guideway 2 and the second opening 50 is assigned to the second tow guideway 3. For the exemplary embodiment shown herein, respectively one perforated plate 52 is positioned behind the slot-shaped openings 49 and 50, thereby allowing the liquid plasticizer to exit in upward direction, in the form of several jets.

At least one cylindrical, rotating brush can be arranged on the inside of the spray box 46, in a manner known per se, which is not shown in further detail and is driven by a motor that is also not shown herein. The plasticizer is supplied from a plasticizer store, not shown herein, with the aid of pumps that are also not shown herein, through one or several non-depicted openings on the side or the underside of the spray box 46.

For the exemplary embodiment, the amount of dispensed plasticizer is controlled in particular by adjusting the opening width of the openings 49 and 50. So-called metering plates 53 and 54 are provided for this, which can be displaced in movement direction of the filter tow strips 4, 6 and can optionally open up or close off the openings 49, 50. The metering plates 53 and 54 are adjusted with the aid of non-depicted control elements, which are actuated independently by a control device that is also not shown herein. The opening width of openings 49, 50 is thus controlled separately. In addition to the individual control of the braking roller pairs 26, 27 and the drawing roller pairs 28 to 31, this feature represents a further option for individually influencing and determining the characteristics of the two filter tow strips 4 and 6, so that different products can be produced from the filter tow strips 4 and 6.

Turbulence can develop in the dispensed plasticizer because of the movement of the initially drawn and then relaxed filter tow strips 4 and 6 across the application apparatus 44. This turbulence undesirably influences the distribution of the dispensed plasticizer and can lead to incorrect wetting. To avoid such incorrect wetting, the two openings 49 and 50 are separated by means of a separating plate, as shown in particular in FIGS. 3 and 5. The separating plate 56 is positioned on the top 48 of the spray box 46, is aligned perpendicular thereto, and extends into the space between the two filter tow strips 4 and 6. A centrally positioned separating wall is additionally provided on the inside of the spray box 46, which is not shown in the Figures. This internal separating wall divides the inside of the spray box 46 into two substantially independent spray chambers. It is therefore advantageous if the previously mentioned rotating brush is also divided into two brushes, wherein each brush is positioned inside one spray chamber and, if applicable, is driven and controlled separately. It is furthermore advantageous in this connection if two pumps are provided, wherein each pump supplies one spray chamber with plasticizer.

Owing to this separate control for the feeding and dispensing of plasticizer, it is furthermore conceivable that an untreated, dry filter tow strip is processed by completely shutting down the feeding and dispensing of plasticizer for one strip while the other filter tow strip continues to be treated normally.

FIGS. 1, 2, 3 and 5 in particular show that first and second transport roller pairs 60 and 61 are arranged downstream of the application apparatus 44, wherein the first transport roller pair 60 is assigned to the first tow guideway 2 and the second transport roller pair 61 is assigned to the second tow guideway 3. The first filter tow strip 4 thus moves through the first transport roller pair 60 and the second filter tow strip 6 moves through the second transport roller pair 61. In the same way as the drawing roller pairs 28, 29 and 30, 31, the transport roller pairs 60 and 61 are also driven separately by non-depicted drives, which are furthermore controlled separately by control means not shown herein. In the same way as the drawing roller pairs 28 to 31, the transport roller pairs 60, 61 for the exemplary embodiment shown herein are positioned on the same side, on the rear wall 32 of the machine frame 20. Thus, for the embodiment and arrangement, we refer to the section of the specification that relates to the drawing roller pairs 28 to 31, in connection with FIG. 4.

Figure 6:
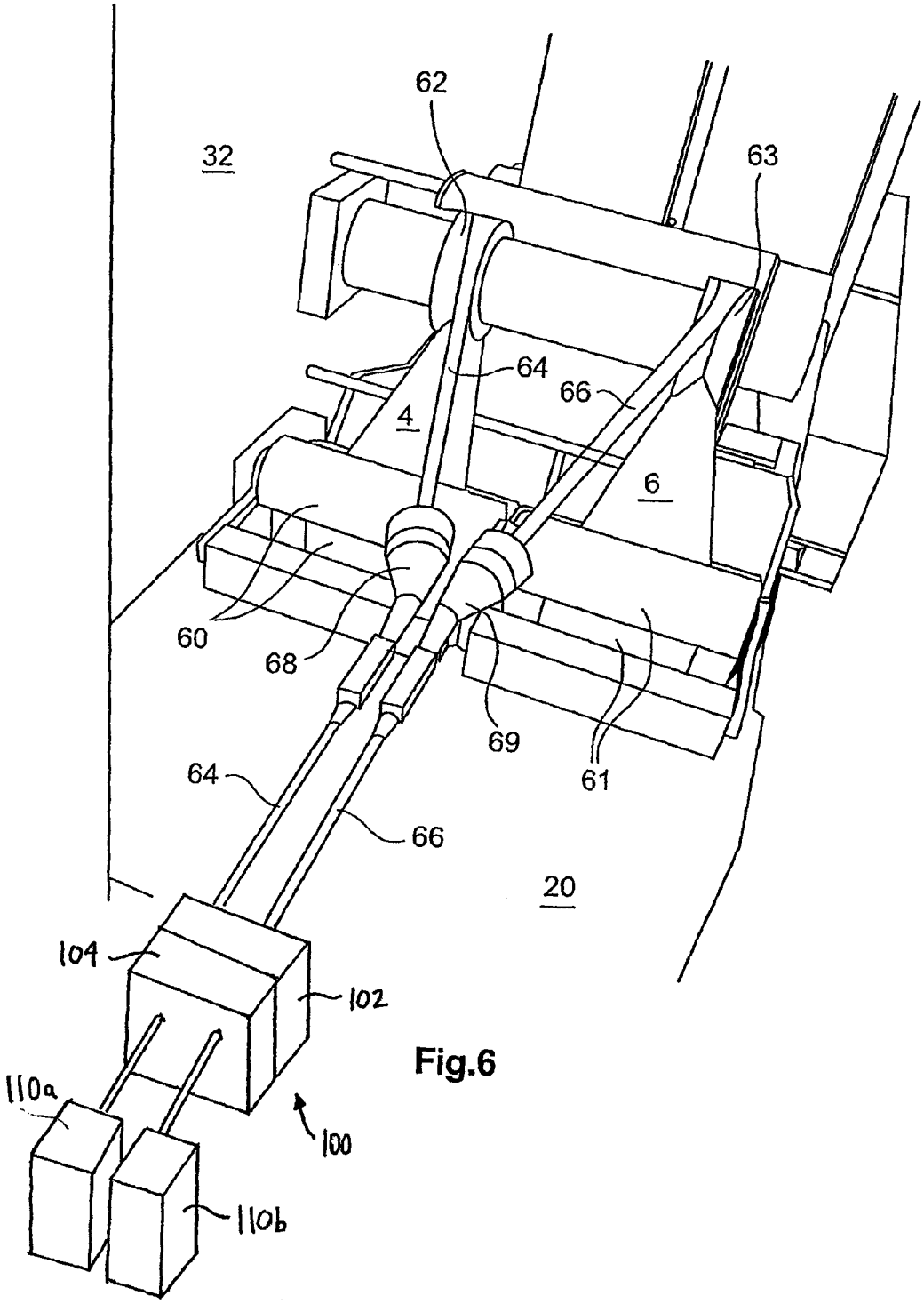
FIG. 6 A schematic, perspective view of the machine in FIG. 1, showing the output side.
Figure 7:
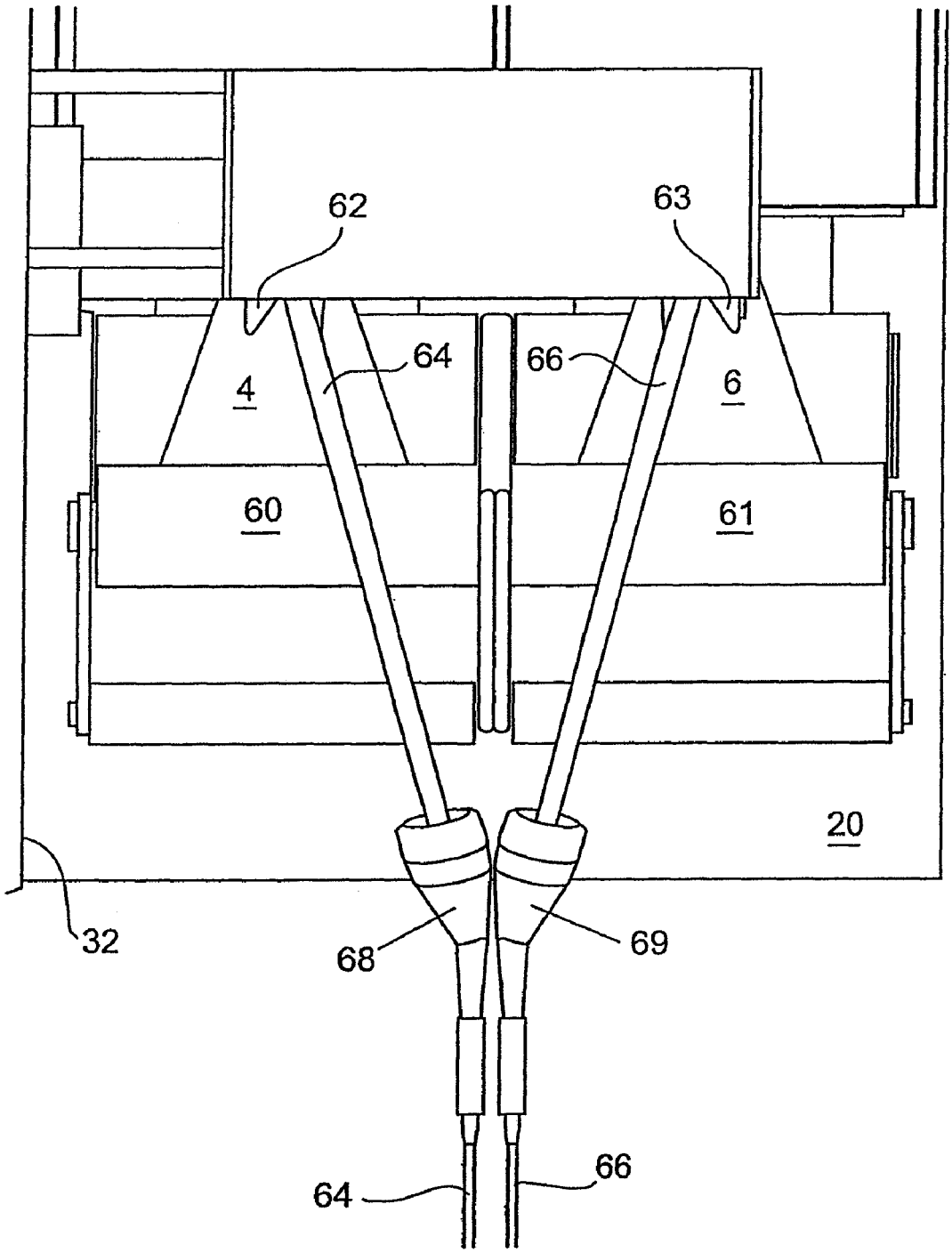
FIG. 7 A view from above of the machine in FIG. 1, showing the output side.

The filter tow strips 4 and 6 are diverted by the transport roller pairs 60 and 61 to above-positioned reshaping rollers 62 and 63, which have a V-shaped peripheral cross section for the present embodiment, as shown in particular in FIGS. 3 and 6. The coaxial, side-by-side positioned deflection rollers 62 and 63 form an arrangement that is positioned on the same side, on the rear wall 32 of the machine frame 20. FIGS. 6 and 7 in particular show that the heretofore flattened filter tow strips 4 and 6 are reshaped into round tow rods 64 and 66 by the shaping rollers 62 and 63.

The center spacing between the tow guideways 2 and 3 is determined by the width of the flattened filter tow strips 4 and 6 and slightly exceeds the combined widths of the filter two strips 4 and 6. In general, the center spacing between both tow guideways 2 and 3 is at least approximately 330 mm. However, for the further processing in a dual-rod machine, the center spacing between the round tow rods 64 and 66, following the shaping rollers 62 and 63, must be reduced to match the center spacing for a dual-rod machine, which generally is 38 mm.

Deflection roller pairs which are not shown herein can be provided downstream of the shaping rollers 62, 63, wherein these deflection rollers can redirect the round tow rods 64, 66 in any optional direction. In the process, the tow rods 64, 66 can also be deflected in rod movement direction or deflection rollers of this type can be used to deflect the tow rods 64, 66 in different directions, for example to supply separately erected single-rod machines. In addition, such a deflection can be used for intertwining or twisting the tow in the drawing zone. In view of the optional deflection, it is furthermore conceivable to set up the previously described processing machine at an angle, relative to the downstream-connected filter rod unit or a cigarette rod maker. Finally, it is also conceivable to use such a deflection for arranging the filter tow bales 8, 9 at a different location, relative to the machine frame 20.

A different option for reducing the center spacing between the two round tow rods 64, 66 is to provide two bent intake fingers 68 and 69, as shown for the exemplary embodiment and illustrated in particular in FIGS. 6 and 7. The two round tow rods 64, 66 for the depicted embodiment travel at a slight angle from the shaping rollers 62, 63 in the direction of the intake fingers 68, 69. Since the deflection rollers 62, 63 deliver a tow rod 64, 66 which moves at a slight angle, the intake fingers 68, 69 have a bent shape, so that the tow rods 64, 66 exiting from the fingers are again oriented parallel to each other with the required, reduced center spacing. FIGS. 6 and 7 in particular show that the intake fingers 68, 69 are hollow and are tapered in movement direction of the tow rods 64, 66. The Figures furthermore show that the intake fingers 68, 69 are bent twice, thereby allowing a particularly soft deflection of the tow rods 64, 66.

Figure 8:
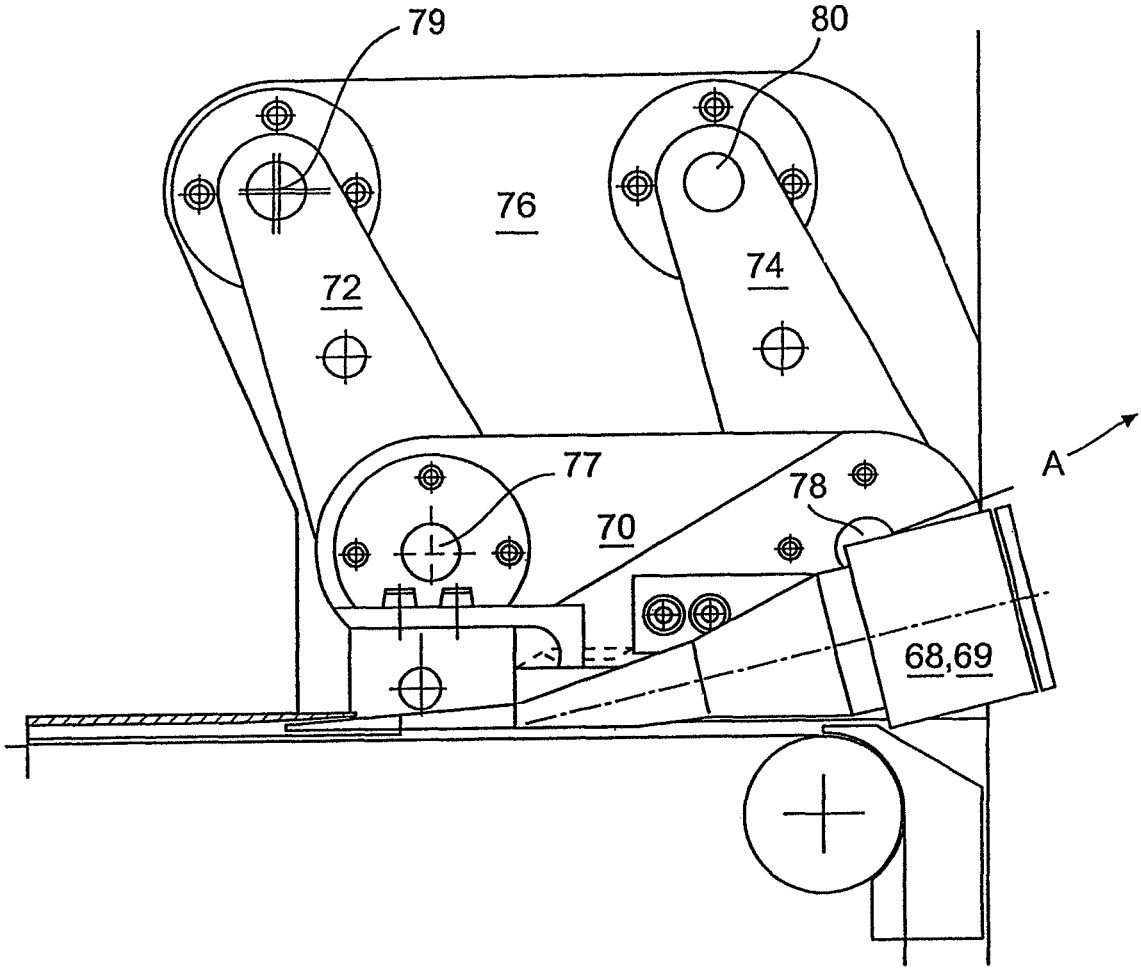
FIG. 8 A schematic, sectional view from the side of an intake finger and its holder which is attached to a parallelogram frame.

To facilitate the operation and maintenance, the intake fingers 68, 69 should be arranged such that they can be pivoted out of the operating position shown in FIGS. 6 and 7. For this, the intake fingers 68, 69 of the exemplary embodiment shown are attached to a support 70, as shown in FIG. 8. This support 70 is suspended so as to swivel from two parallel arranged pivoting arms 72, 74, attached to a support element 76, which in turn is mounted on the machine frame 20, preferably on its rear wall 32 (compare also FIG. 1). The two pivoting arms 72, 74 form a parallelogram in that the pivoting axis for the first joint, which connects the first pivoting arm 72 to the holder 70, is positioned at the same distance to the pivoting axis for the second joint, which connects the second pivoting arm 74 to the holder 70, in the same way as the pivoting axis for the third joint 79, which connects the first pivoting arm 72 to the support element 76, is positioned relative to the fourth joint 80 that connects the second pivoting arm 74 to the support element 76. The aforementioned pivoting axes for the exemplary embodiment shown extend at right angles to the movement direction of the tow rods 64, 66. For the exemplary embodiment, the holder 70 which holds both intake fingers 68, 69 is thus suspended from a parallelogram which can be pivoted in the direction of the tow rods. As a result, the two intake fingers 68, 69 can be pivoted out of the operating position, shown in FIGS. 6 to 8, in the direction counter to the movement direction of the tow rods 64, 66 and thus in upstream direction as shown with arrow A in FIG. 8.

The previously described machine is followed downstream by a filter rod unit 100 which is shown schematically in FIGS.

2 and 6. This filter rod unit 100 among other things is provided with an apparatus 102 for wrapping paper around the tow rods 64, 66, as well as an adhesive applicator 104 for gluing the paper wrapped around the filter rod. The use of a slow-curing adhesive, in particular cold glue, or a fast-curing adhesive, especially hot-melt glue, is known. Owing to the different properties of these adhesives, it suggests itself to design the adhesive applicator 104 in such a way that both types of adhesive can be applied. The advantage of such a measure is that the fast-curing adhesive initially causes an immediate fixation of the wrapping paper while the slow-curing adhesive causes a permanent bonding. One disadvantage of a fast-curing adhesive such as hot-melt glue is its characteristic of losing its adhesive effect after some time. The dual application of a fast-curing and a slow-curing adhesive therefore offers itself, especially with high processing speeds. For lower processing speeds, on the other hand, the application of a slow-curing adhesive is sufficient, in particular for a partial-load operation which can be realized especially with the previously described dual-rod machine.

Finally, two independent removal devices 110*a*, 110*b* can be provided for transferring the products to two filter delivery units on two different cigarette makers. By providing separate removal devices of this type, which are shown schematically in FIGS. 2 and 6, it is possible to supply and operate different and in particular separately erected filter rod units or cigarette makers. Removal devices of this type preferably comprise a pusher drum or a transfer spider.

The invention claimed is:

1. A device for processing filter tow material for the production of filters for rod-shaped smoking articles, said device comprising:

a filter tow supply configured to supply at least two filter tow strips;

at least two tow guideways, wherein each of the at least two filter tow strips is separately guided in a respective one of the at least two tow guideways; and a separately controlled processing apparatus assigned to each tow guideway for processing the respective filter tow strip, wherein each processing apparatus comprises:

first and second drawing roller pairs, wherein the first drawing roller pair in one of the at least two tow guideways is arranged coaxial and side-by-side in a single unit with the first drawing roller pair in the other of the at least two tow guideways to define first inner and outer drawing roller pairs, and wherein the second drawing roller pair in one of the at least two tow guideways is arranged coaxial and side-by-side in a single unit with the second drawing roller pair in the other of the at least two tow guideways to define second inner and outer drawing roller pairs, and wherein the first and second inner and outer drawing roller pairs are positioned and supported on only one side.

2. The device according to claim 1, wherein the filter tow supply comprises two side-by-side arranged filter tow bales to provide a different filter tow material to each tow guideway.

3. The device according to claim 1, wherein each processing apparatus further comprises means for flattening and means for treating the filter tow strip.

4. The device according to claim 3, wherein each means for flattening is arranged side-by-side and transverse to a direction of the tow guideways with each other respective means for flattening in a single unit, and wherein each means for treating is arranged side-by-side and transverse to the direction of the tow guideways with each other respective means for treating in a single unit.

5. The device according to claim 3, wherein each means for flattening comprises first spreader nozzle and a second spreader nozzle constructed to flatten the respective filter tow strip, and wherein the means for treating comprises a spray box arrangement that extends across the tow guideways, the spray box including first and second adjacent, slot-shaped openings assigned, respectively, to the first and second tow guideways.

6. The device according to claim 1, wherein each drawing roller pair is separately driven by an associated drive means.

7. The device according to claim 1, further comprising:

a separate removal device provided at an end of each tow guideway to separately transfer the filter tow strips, wherein each removal device comprises a pusher drum or a transfer spider.

8. The device according to claim 1, further comprising:

an apparatus for wrapping a material around the filter tow strips; and an adhesive applicator for gluing together the wrapping material, wherein the adhesive applicator comprises first means for applying slow-curing adhesive, and second means for applying fast-curing adhesive.

9. The device according to claim 8, wherein the slow-curing adhesive comprises cold glue, and wherein the fast-curing adhesive comprises hot-melt glue.

10. The device according to claim 1, wherein the rod-shaped smoking articles comprise cigarettes.

11. The device according to claim 1, wherein the first and second inner and outer drawing roller pairs are supported on a vertical back wall of a machine frame.

12. A device for processing filter tow material for the production of filters for rod-shaped smoking articles, said device comprising:

filter tow delivery means for supplying at least two filter tow strips;

at least two tow guideways, wherein each of the at least two filter tow strips is separately guided in a respective one of the at least two tow guideways; and processing apparatuses for processing the filter tow strips, wherein each tow guideway is assigned a separately controlled processing apparatus comprising means for drawing a respective one of the at least two filter tow strips, wherein each means for drawing comprises a roller pair, and wherein the roller pair in one of the at least two tow guideways is arranged coaxial and side-by-side in a single unit with the roller pair in the other of the at least two tow guideways to define inner and outer roller pairs, wherein a first roller of the outer roller pair is positioned on a first shaft and a first roller of the inner roller pair is positioned on a first tubular shaft through which the first shaft extends.

13. The device according to claim 12, wherein a second roller of the outer roller pair is positioned on a second shaft and a second roller of the inner roller pair is positioned on a second tubular shaft through which the second shaft extends.

14. A device for processing filter tow material for the production of filters for rod-shaped smoking articles, said device comprising:

filter tow delivery means for supplying at least two filter tow strips;

at least two tow guideways, wherein each of the at least two filter tow strips is separately guided in a respective one of the at least two tow guideways; and processing apparatuses for processing the filter tow strips, wherein each tow guideway is assigned a separately controlled processing apparatus, wherein each processing apparatus comprises means for flattening, drawing, and/or treating a respective one of the at least two filter tow strips, wherein the means for treating comprises a spray box arrangement that extends across the tow guideways, wherein the spray box arrangement comprises discharge openings in a wall facing the tow guideways, which discharge openings are assigned to the tow guideways for dispensing treatment fluid onto the filter tow strips, and wherein a first separating wall is arranged within the spray box arrangement between the tow guideways and a second separating wall is arranged between the tow guideways on the wall facing the tow guideways.

15. The device according to claim 14, wherein the cross section for each discharge opening can be changed separately, relative to the tow guideways, with the aid of movable metering plates.

16. The device according to claim 14, wherein the spray box arrangement is constructed to be operated under pressure.

17. The device according to claim 14, wherein the spray box arrangement comprises at least one rotating brush, operated by a drive, which dispenses the treatment fluid through the discharge openings.

18. A device for processing filter tow material for the production of filters for rod-shaped smoking articles, said device comprising:

filter tow delivery means for supplying at least two filter tow strips;

at least two tow guideways, wherein each of the at least two filter tow strips is separately guided in a respective one of the at least two tow guideways;

processing apparatuses for processing the filter tow strips, wherein each tow guideway is assigned a separately controlled processing apparatus;

a shaping device for reshaping the filter tow strips into round filter tow rods; and deflection means provided downstream of the shaping device for deflecting the round filter tow rods to reduce a center spacing between the round filter tow rods.

19. The device according to claim 18, wherein the deflection means comprises conical intake fingers which are bent twice to reduce the spacing between the filter tow rods, wherein each respective filter tow rod is guided through a respective one of the conical intake fingers.

20. The device according to claim 19, wherein the conical intake fingers are attached to a joint holder, suspended from a parallelogram frame, which can essentially be pivoted in the direction of the filter tow rods.

* * * * *